US006771173B1

(12) United States Patent
Clayton et al.

(10) Patent No.: US 6,771,173 B1
(45) Date of Patent: Aug. 3, 2004

(54) SYSTEM AND DEVICE FOR MONITORING AND SIGNALING PERSONNEL PRESENCE

(75) Inventors: Diane J. Clayton, Kingston (CA); Stephen S. Jackson, Chapel Hill, NC (US)

(73) Assignee: Nortel Networks Limited (CA)

( * ) Notice: Subject to any disclaimer, the term of this patent is extended or adjusted under 35 U.S.C. 154(b) by 0 days.

(21) Appl. No.: 09/752,143

(22) Filed: Dec. 29, 2000

(51) Int. Cl.[7] ..... G08B 23/00

(52) U.S. Cl. ..... 340/573.1; 340/541; 340/565; 340/567; 340/539.23

(58) Field of Search ..... 340/573.1, 573.4, 340/541, 545.3, 551, 565, 567, 538, 310.01, 825.06, 10.1, 825.36, 825.49, 539.13, 539.23; 250/342, DIG. 1

(56) References Cited

U.S. PATENT DOCUMENTS 5,459,450 A * 10/1995 Beghelli ..... 340/538
5,565,844 A * 10/1996 Bedrosian ..... 340/567
5,703,367 A * 12/1997 Hashimoto et al. ..... 250/342
6,081,193 A * 6/2000 Trucchi et al. ..... 340/541
6,163,257 A * 12/2000 Tracy ..... 340/506
6,288,641 B1 * 9/2001 Casais ..... 340/539

* cited by examiner

*Primary Examiner*—Toan N. Pham
(74) *Attorney, Agent, or Firm*—Steubing McGuinness & Manaras LLP

(57) ABSTRACT

A system, device, and method for monitoring and signaling personnel presence uses a personnel presence sensor capable of detecting physical presence and proximity of a person within a space. Personnel presence monitoring/signaling logic determines any of a number of personnel presence conditions based upon personnel presence information obtained from one or more such sensors, and may signal any of a number of personnel presence conditions. The personnel presence monitoring/signaling logic may be coupled to a communication network for remote monitoring and control.

37 Claims, 12 Drawing Sheets

SYSTEM AND DEVICE FOR MONITORING AND SIGNALING PERSONNEL PRESENCE

CROSS-REFERENCE TO RELATED APPLICATION(S)

The present application may be related to the following commonly owned United States patent applications, which are hereby incorporated herein by reference in their entireties:

U.S. patent application Ser. No. 09/456,567 entitled ELECTRIC FIELD PROXIMITY DETECTOR FOR FLOATING AND GROUNDED TARGETS, filed on Dec. 8, 1999 in the names of Andre J. Van Schyndel and Diane J. Clayton;

U.S. patent application Ser. No. 09/707,082 entitled SYSTEM, DEVICE, AND METHOD FOR CONFIGURING A DEVICE, filed on Nov. 6, 2000 in the names of Stephen S. Jackson and Franco Travostino; and U.S. patent application Ser. No. 09/707,280 entitled SYSTEM, DEVICE, AND METHOD FOR PROVIDING PERSONALIZED SERVICES IN A COMMUNICATION SYSTEM, filed on Nov. 6, 2000 in the names of Stephen S. Jackson and Franco Travostino.

FIELD OF THE INVENTION

The present invention relates generally to communication networks, and more particularly to monitoring and signaling personnel presence in a communication network.

BACKGROUND OF THE INVENTION

Central alarm systems are often installed in buildings to detect intruders, smoke, fire, and other conditions. A central alarm system typically includes such things as central controller for controlling the central alarm system, various sensors for detecting certain conditions (e.g., active-open and active-closed switches for windows and doors, motion detectors, glass break detectors, smoke detectors), remote keypads for communicating with the central controller, and various output devices for notifying occupants or others of an alarm condition (e.g., siren, horn, buzzer). The central alarm system components are typically installed in a substantially permanent manner within the building, often using dedicated wiring to connect the various components.

Such alarm systems are often monitored by a monitoring service. Typically, the monitoring service receives a telephone call or other indication from the central controller when the central controller detects an alarm condition. The monitoring service may be able to communicate with the central controller, for example to clear an alarm condition or bypass an alarm zone, but is unable to monitor and communicate directly with the individual alarm system components.

Within such alarm systems, motion detectors are often used to detect motion within some space. Motion detectors have certain limitations. One limitation is that motion detectors are relatively expensive, and therefore a typical central alarm system includes few motion detectors. Another limitation is that motion detectors only detect a person when the person moves, and otherwise do not detect the presence of a person who is motionless. This is typically sufficient for an alarm system, since the alarm system generates an alarm indication upon such detection.

SUMMARY OF THE INVENTION

A personnel presence sensor is used to detect physical presence and proximity of a person within a space. Personnel presence monitoring/signaling logic determines any of a number of personnel presence conditions based upon personnel presence information obtained from one or more such sensors, and may signal any of a number of personnel. presence conditions. The personnel presence monitoring/signaling logic may be coupled to a communication network for remote monitoring and control.

BRIEF DESCRIPTION OF THE DRAWINGS

The foregoing and other objects and advantages of the invention will be appreciated more fully from the following further description thereof with reference to the accompanying drawings wherein:

FIG. 11 is a logic flow diagram showing an example of personnel presence monitoring/signaling logic for signaling the position of a person within a space sensor in accordance with an embodiment of the present invention; and.

DETAILED DESCRIPTION OF A PREFERRED EMBODIMENT

Figure 1:
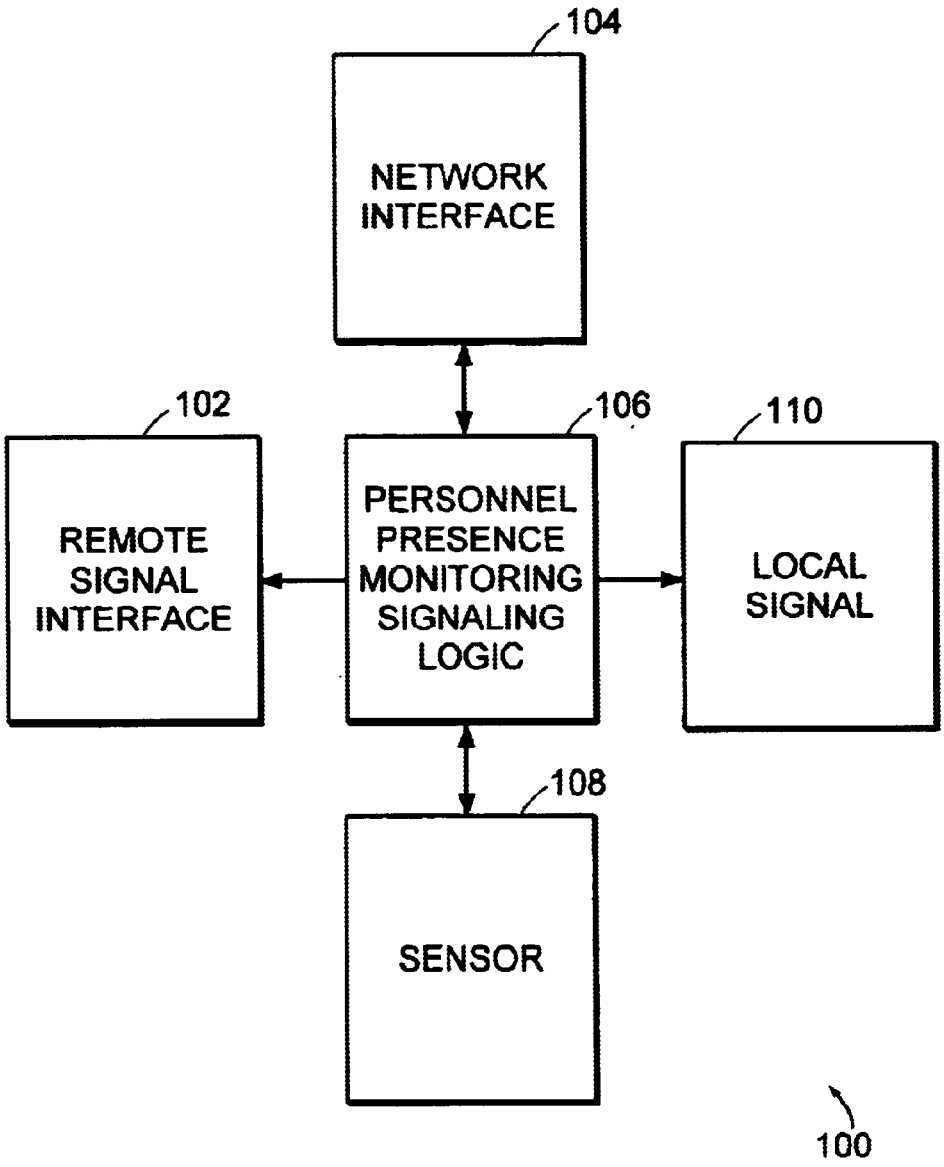
FIG. 1 is a block diagram showing an example of a personnel presence monitoring/signaling system that includes at least personnel presence monitoring/signaling logic and at least one sensor in accordance with an embodiment of the present invention.

In an embodiment of the present invention, sensors of the type described in the related application entitled ELECTRIC FIELD PROXIMITY DETECTOR FOR FLOATING AND GROUNDED TARGETS, which was incorporated by reference above, are used for detecting personnel presence and location within a space. Such sensors are capable of detecting personnel presence and location (e.g., distance from the sensor) whether a person is in motion or motionless. Each sensor typically generates an output signal that varies according to the distance between the person and the sensor.

In various embodiments of the present invention, personnel presence information from one or more sensors is processed by personnel presence monitoring/signaling logic. Within a personnel presence monitoring/signaling system, the personnel presence monitoring/signaling logic may be used with one or more sensors in any of a variety of configurations. Generally speaking, the personnel presence monitoring/signaling logic may be integrated with one or more sensors, for example, within a personnel presence monitoring/signaling device, or may be coupled remotely to the sensor(s), for example, over a wireless or wire-line communication system. The personnel presence monitoring/signaling logic may receive the personnel presence information from the sensor(s) and/or retrieve the personnel presence information from the sensor(s).

Because the sensors detect personnel presence rather than mere personnel motion, the personnel presence monitoring/signaling logic is able to monitor and signal any of a variety of personnel presence conditions for a particular sensor or space, and particularly many personnel presence conditions that would otherwise be undetectable using a traditional motion detector. For example, using the personnel presence information obtained from the sensor(s), the personnel presence monitoring/signaling logic can monitor and signal personnel presence conditions including, but not limited to, absence of a person from the space, initial presence of the person in the space, continued presence of the person in the space, proximity of the person to a sensor, position of the person within the space, movement of the person within the space, absence of movement of the person within the space, and egress of the person from the space. The personnel presence monitoring/signaling logic may determine the position of the person within the space using personnel presence information obtained from multiple sensors, for example, using triangulation.

The personnel presence monitoring/signaling logic may signal a personnel presence condition using any of a variety of mechanisms. For example, the personnel presence monitoring/signaling logic may signal a personnel presence condition by such things as turning on a light, sounding an alarm, or placing a telephone call, to name but a few. Alternatively, or additionally, the personnel presence monitoring/signaling logic may be coupled through a network interface to a communication network such as the Internet, thereby enabling a remote terminal to control the personnel presence monitoring/signaling logic, monitor personnel presence conditions, retrieve personnel presence information from the personnel presence monitoring/signaling logic, and receive personnel presence signals from the personnel presence monitoring/signaling logic remotely over the communication network. The personnel presence monitoring/signaling logic may actively signal the remote terminal over the communication network and/or may store personnel presence information for retrieval by the remote terminal.

FIG. 1 shows an example of a personnel presence monitoring/signaling system 100 that includes at least personnel presence monitoring/signaling logic 106 and at least one sensor 108. The personnel presence monitoring/signaling logic 106 obtains personnel presence information from the at least one sensor 108 that indicates such things as presence (or absence) of a person, proximity of a person to the sensor 106, and movement of a person. The personnel presence monitoring/signaling logic 106 may receive the personnel presence information from the at least one sensor 108 and/or retrieve the personnel presence information from the at least one sensor 108. Using the personnel presence information obtained from the at least one sensor 108, the personnel presence monitoring/signaling logic 106 may monitor and signal any of a variety of personnel presence conditions for a particular sensor or space, including, but not limited to, absence of a person from the space, initial presence of the person in the space, continued presence of the person in the space, proximity of the person to a sensor, movement of the person within the space, and egress of the person from the space. The personnel presence monitoring/signaling logic 106 may generate a personnel presence signal to signal a predetermined personnel presence condition and/or store personnel presence information for retrieval by a remote terminal. For example, the personnel presence monitoring/signaling logic 106 may generate the personnel presence signal based upon presence of a person within a space, absence of a person from a space, position of a person within a space, movement of a person within a space, and absence of movement of a person within a space, to name but a few.

The personnel presence monitoring/signaling system 100 may include a local signal 110, such as a light or buzzer, that is controlled by the personnel presence signal generated by the personnel presence monitoring/signaling logic 106.

The personnel presence monitoring/signaling system 100 may include a remote signal interface 102 through which a remote signal, such as a light or buzzer, is controlled by the personnel presence signal generated by the personnel presence monitoring/signaling logic 106.

The personnel presence monitoring/signaling system 100 may include a network interface 104 for coupling the personnel presence monitoring/signaling logic 106 to a communication network. Such an arrangement permits signaling of personnel presence conditions to a remote terminal over the communication network and/or permits remote monitoring and control of the personnel presence monitoring/signaling logic 106 and the at least one sensor 108 by a remote terminal over the communication network. The personnel presence monitoring/signaling logic 106 may be coupled to any of a variety of communication networks using any of a variety of communication technologies. For one example, the personnel presence monitoring/signaling logic 106 may be coupled to a telephone network (e.g., POTS, cellular, broadband cable) for calling a predetermined remote terminal (e.g., monitoring service, home owner's cellular phone) upon detecting a predetermined personnel presence condition. For another example, the personnel presence monitoring/signaling logic 106 may be coupled to an IP network (e.g., the Internet) via telephone (modem), ADSL, broadband cable, wireless, or other communication technology for communicating with a remote terminal (e.g., monitoring service, remote computer).

Figure 2:
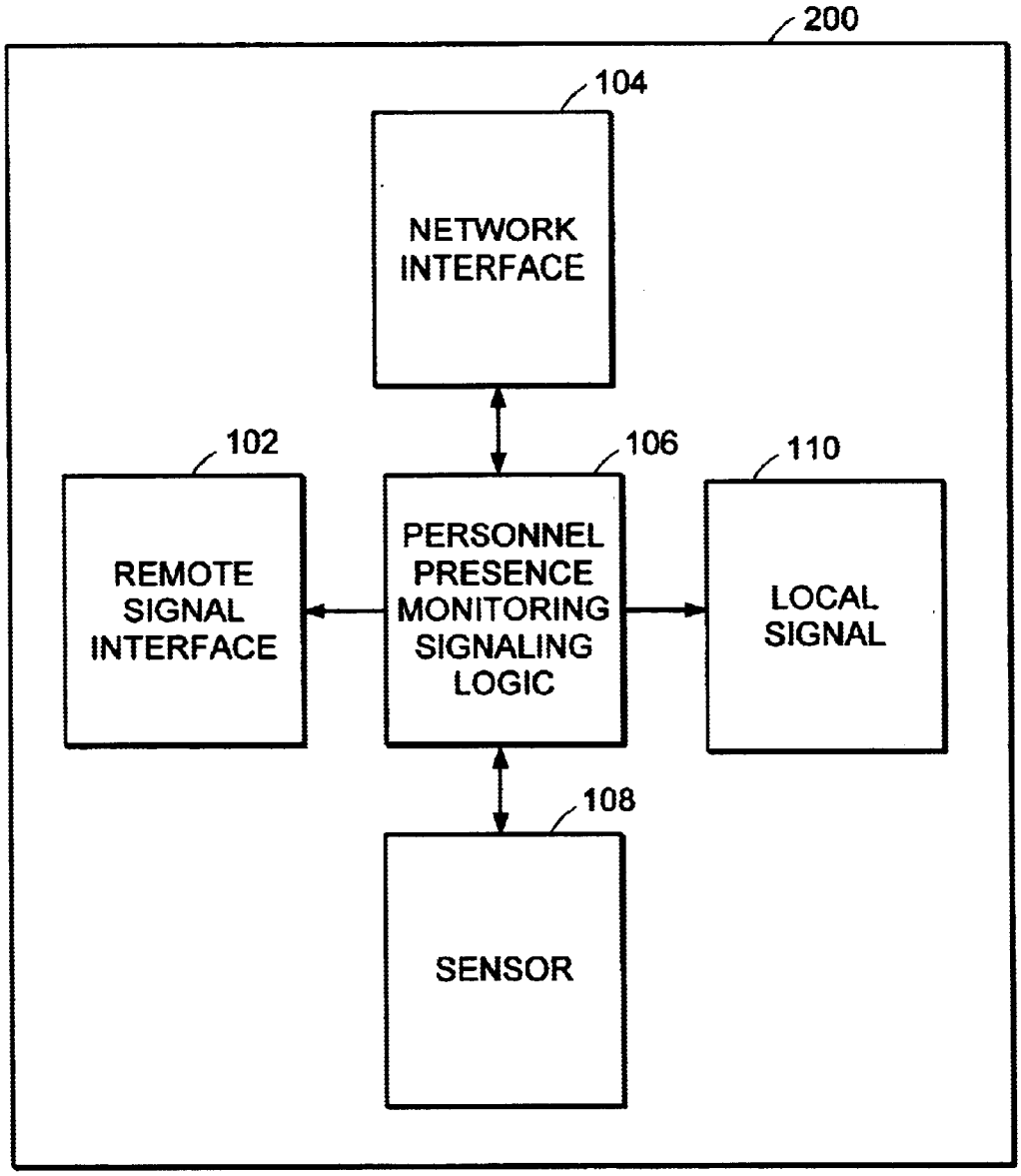
FIG. 2 is a block diagram showing an example of an integrated personnel presence monitoring/signaling device sensor in accordance with an embodiment of the present invention.

FIG. 2 shows an example of an integrated personnel presence monitoring/signaling device 200. The integrated personnel presence monitoring/signaling device 200 includes at least the personnel presence monitoring/signaling logic 106 and the at least one sensor 108, and also includes the local sensor 110, the remote signal interface 102, and/or the network interface 104. The personnel presence monitoring/signaling device 200 can be situated within a space for operating as a stand-alone device for monitoring and signaling personnel presence.

Figure 3:
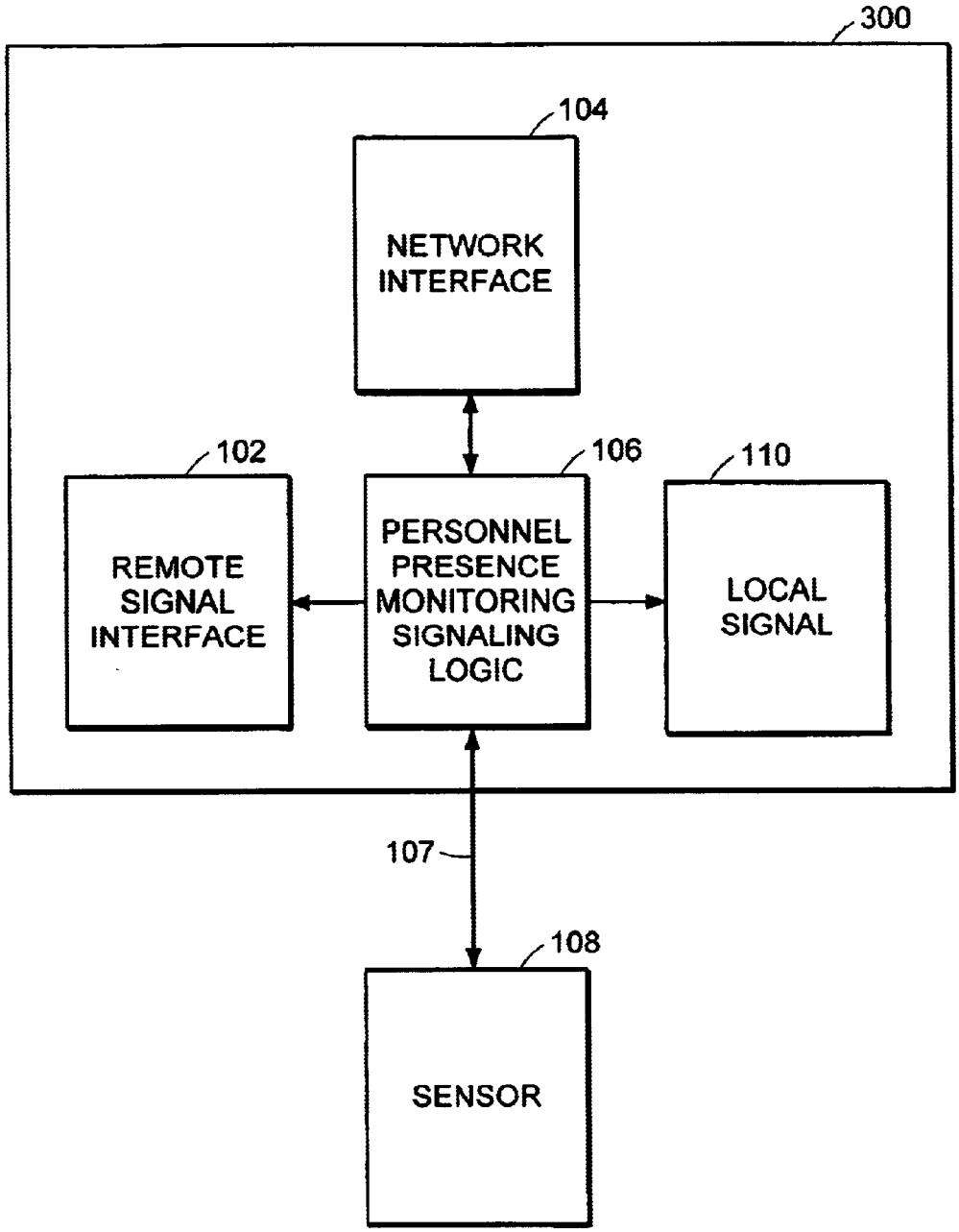
FIG. 3 is a block diagram showing an example of a personnel presence monitoring/signaling device for use as a central controller in a distributed personnel presence monitoring/signaling system sensor in accordance with an embodiment of the present invention.

FIG. 3 shows an example of a personnel presence monitoring/signaling device 300 for use as a central controller in a distributed personnel presence monitoring/signaling system. The personnel presence monitoring/signaling device 300 includes the personnel presence monitoring/signaling logic 106, and also includes the local sensor 110, the remote signal interface 102, and/or the network interface 104. The personnel presence monitoring/signaling logic 106 in the personnel presence monitoring/signaling device 300 is coupled to the at least one sensor 108 over a communication medium 107, such as a wireless (e.g., Bluetooth) or wire-line (e.g., power line) communication system. The at least one sensor 108 can be placed within a space, and provides personnel presence information to the personnel presence monitoring/signaling logic 106 in the personnel presence monitoring/signaling device 300 indicating such things as presence (or absence) of a person, proximity of a person to the at least one sensor 108, and movement of a person. The personnel presence monitoring/signaling logic 106 in the personnel presence monitoring/signaling device 300 may receive the personnel presence information from the at least one sensor 108 and/or retrieve the personnel presence information from the at least one sensor 108. Using the personnel presence information obtained from the at least one sensor 108, the personnel presence monitoring/signaling logic 106 in the personnel presence monitoring/signaling device 300 may monitor and signal any of a variety of personnel presence conditions for a particular sensor or space, including, but not limited to, absence of a person from the space, initial presence of the person in the space, continued presence of the person in the space, proximity of the person to a sensor, movement of the person within the space, and egress of the person from the space. The personnel presence monitoring/signaling logic 106 in the personnel presence monitoring/signaling device 300 may determine the position of the person within the space using personnel presence information obtained from multiple sensors, for example, using triangulation.

One example of a personnel presence monitoring/signaling device is a Data Appliance Gateway (DAG), as described in the related application entitled SYSTEM, DEVICE, AND METHOD FOR CONFIGURING A DEVICE, which was incorporated by reference above. The at least one sensor 108 may be integral to the DAG, as in the personnel presence monitoring/signaling device 200 shown and described with reference to FIG. 2 above, or external to the DAG, as in the personnel presence monitoring/signaling device 300 shown and described with reference to FIG. 3 above. The DAG may detect the physical presence of a user through the at least one sensor 108, and configure various devices within a personal area of the user. The DAG may also provide various personalized services for the user, as described in the related application entitled SYSTEM, DEVICE, AND METHOD FOR PROVIDING PERSONALIZED SERVICES IN A COMMUNICATION SYSTEM, which was incorporated by reference above.

Figure 4:
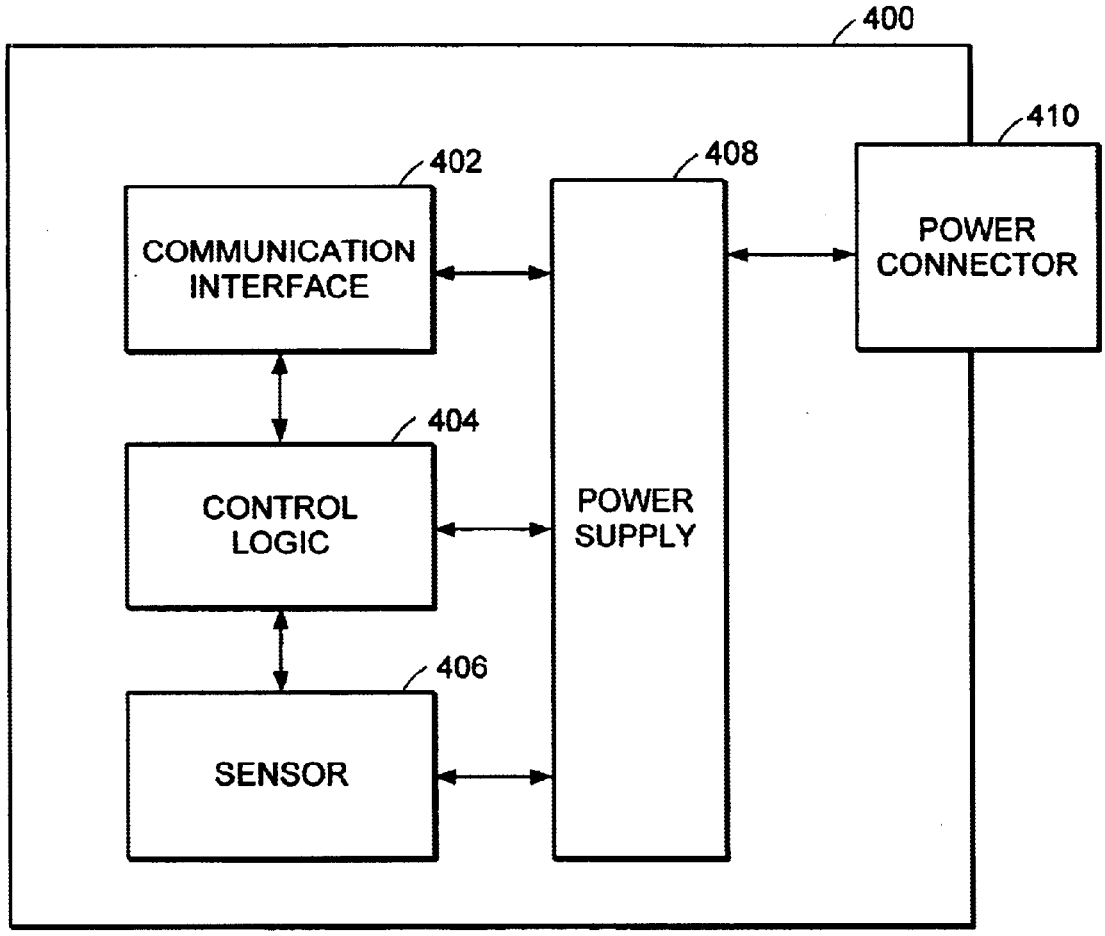
FIG. 4 shows an example of such a plug-in sensor sensor in accordance with an embodiment of the present invention.

In order to facilitate the deployment of the at least one sensor 108 in a distributed personnel presence monitoring/signaling system, such as the personnel presence monitoring/signaling system shown and described with reference to FIG. 3 above, each sensor 108 may be packaged along with a communication interface and associated control logic in an inexpensive plug-in form factor that can be plugged directly into an electrical outlet. FIG. 4 shows an example of such a plug-in sensor 400. Among other things, the plug-in sensor 400 includes a power connector 410, a power supply 408, a sensor 406, a communication interface 402, and control logic 404. The power connector 410 enables the plug-in sensor 400 to be plugged into an electrical power source, such as a standard, household 120 VAC power source. The power supply 408 is coupled to the power connector 410, and provides power to the internal components of the plug-in sensor 400, including the communication interface 402, the control logic 404, and the sensor 406. The sensor 406 is typically a personnel presence sensor of the type described above, with its output signal coupled as an input to the control logic 404. The control logic 404 performs various control functions, such as interfacing the communication interface 402 to the sensor 406 and converting the output signal from the sensor 406 to a form that is usable by the personnel presence monitoring/signaling logic 106. The communication interface 402 may utilize any of a variety of communication technologies to permit internetworking and remote monitoring of the plug-in sensor 400 over the communication medium 107, including, but not limited to, power line communication technologies, wireless communication technologies (e.g., Bluetooth), and other communication technologies (e.g., Ethernet).

Because of the nature of the at least one sensor 108, the personnel presence monitoring/signaling logic 106 can monitor and signal any of a variety of personnel presence conditions. Although the possible personnel presence conditions are too numerous to list herein, a number of examples are included below.

One personnel presence condition is whether or not a person is present in a space. Because the at least one sensor 108 detects personnel presence rather than mere personnel movement, the personnel presence monitoring/signaling logic 106 can determine whether or not a person is present in the space. Signaling of such a personnel presence condition may be useful, for example, in determining whether or not an intruder remains in a building (i.e., whether or not it is safe to enter).

Figure 5:
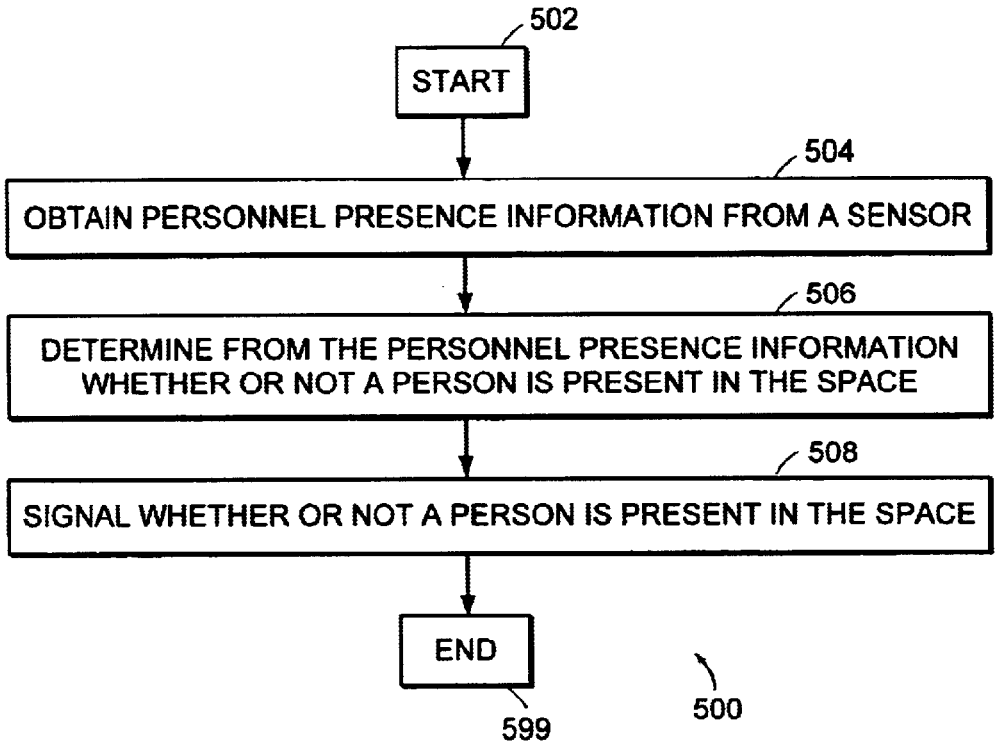
FIG. 5 is a logic flow diagram showing an example of personnel presence monitoring/signaling logic for signaling whether or not a person is present in a space sensor in accordance with an embodiment of the present invention.

FIG. 5 shows an example of personnel presence monitoring/signaling logic 500 for signaling whether or not a person is present in a space. Beginning at block 502, the logic obtains personnel presence information from a sensor, in block 504. The logic determines from the personnel presence information whether or not a person is present in the space, in block 506. The logic signals whether or not a person is present in the space, in block 508. The logic 500 terminates in block 599.

Another personnel presence condition is that a person has entered a space. Such a personnel presence condition may be determined by the personnel presence monitoring/signaling logic 106 upon detecting the presence of a person in the space where no person had been present in the space.

Figure 6:
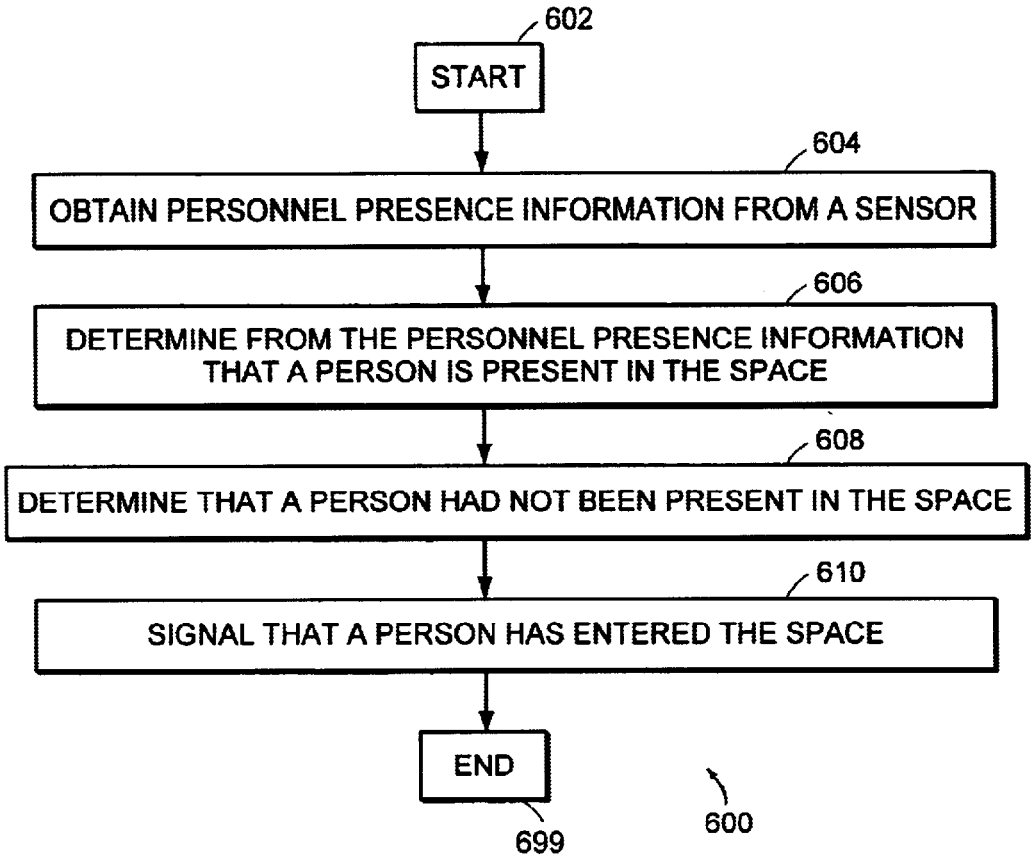
FIG. 6 is a logic flow diagram showing an example of personnel presence monitoring/signaling logic for signaling that a person has entered a space sensor in accordance with an embodiment of the present invention.

FIG. 6 shows an example of personnel presence monitoring/signaling logic 600 for signaling that a person has entered a space. Beginning at block 602, the logic obtains personnel presence information from a sensor, in block 604. The logic determines from the personnel presence information that a person is present in the space, in block 606. The logic determines that a person had not been present in the space, in block 608. The logic signals that a person has entered the space, in block 610. The logic 600 terminates in block 699.

Yet another personnel presence condition is that a person has moved within a space. Such a personnel presence condition may be determined by the personnel presence monitoring/signaling logic 106 upon detecting a change in the output signal from the at least one sensor 108.

Figure 7:
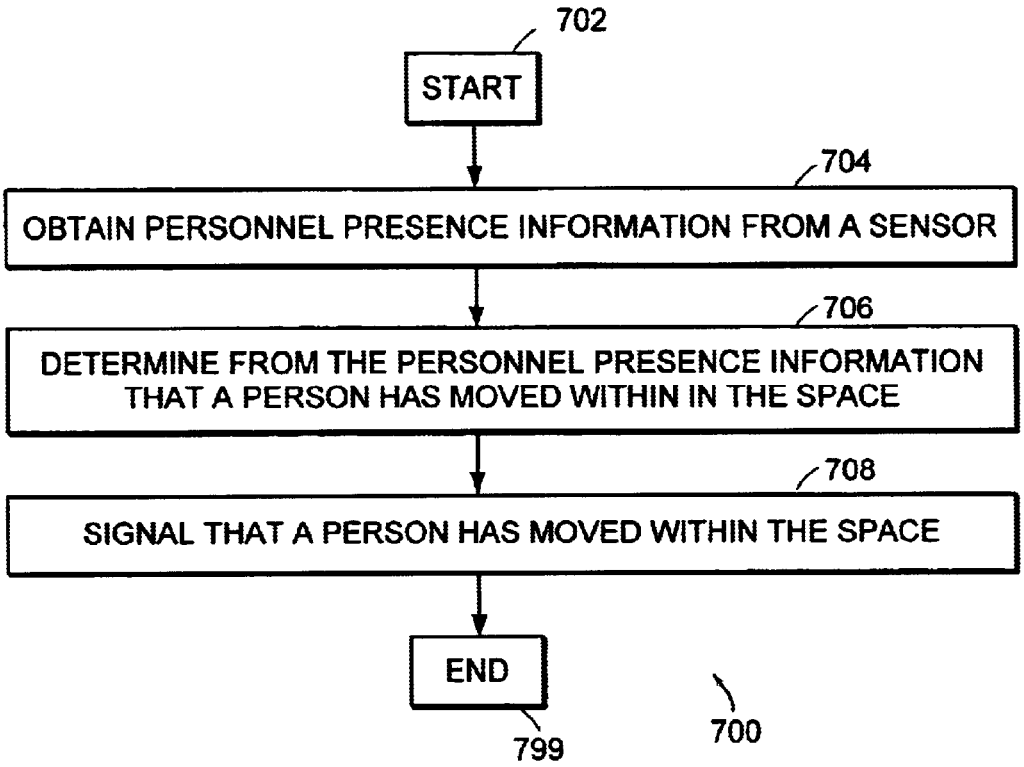
FIG. 7 is a logic flow diagram showing an example of personnel presence monitoring/signaling logic for signaling that a person has moved within a space sensor in accordance with an embodiment of the present invention.

FIG. 7 shows an example of personnel presence monitoring/signaling logic 700 for signaling that a person has moved within a space. Beginning at block 702, the logic obtains personnel presence information from a sensor, in block 704. The logic determines from the personnel presence information that a person has moved within the space, in block 706. The logic signals that a person has moved within the space, in block 708. The logic 700 terminates in block 799.

Still another personnel presence condition is that a person remains present in a space. Because the at least one sensor 108 detects personnel presence rather than mere personnel movement, the personnel presence monitoring/signaling logic 106 can determine whether a person remains present in the space, even if the person is not moving. Signaling of such a personnel presence condition may be useful, for example, in determining whether an intruder remains in a building (i.e., that it is not safe to enter).

Figure 8:
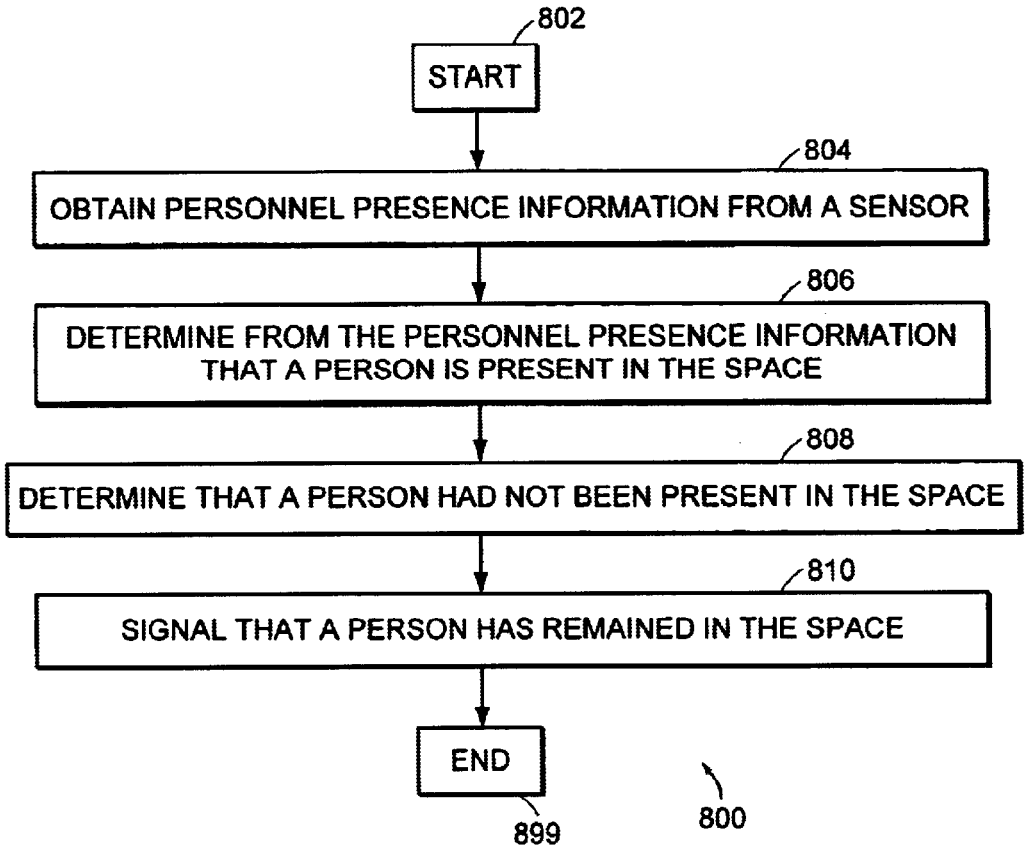
FIG. 8 is a logic flow diagram showing an example of personnel presence monitoring/signaling logic for signaling that a person remains present in a space sensor in accordance with an embodiment of the present invention.

FIG. 8 shows an example of personnel presence monitoring/signaling logic 800 for signaling that a person remains present in a space. Beginning at block 802, the logic obtains personnel presence information from a sensor, in block 804. The logic determines from the personnel presence information that a person is present in the space, in block 806. The logic determines that a person had been present in the space, in block 808. The logic signals that a person has remained in the space, in block 810. The logic 800 terminates in block 899.

Still another personnel presence condition is that a person has not moved for a predetermined amount of time. Because the at least one sensor 108 detects personnel presence rather than mere personnel movement, and the output signal from the at least one sensor 108 varies according to the proximity of the person to the at least one sensor 108, the personnel presence monitoring/signaling logic 106 may determine that a person has not moved if the at least one sensor 108 indicates that a person is present, but the output signal has not varied for a predetermined amount of time. Signaling of such a personnel presence condition may be useful, for example, in determining that someone has become incapacitated (e.g., an elderly person at home, a patient in a hospital, a child, a policeman or fireman in a dangerous situation).

Figure 9:
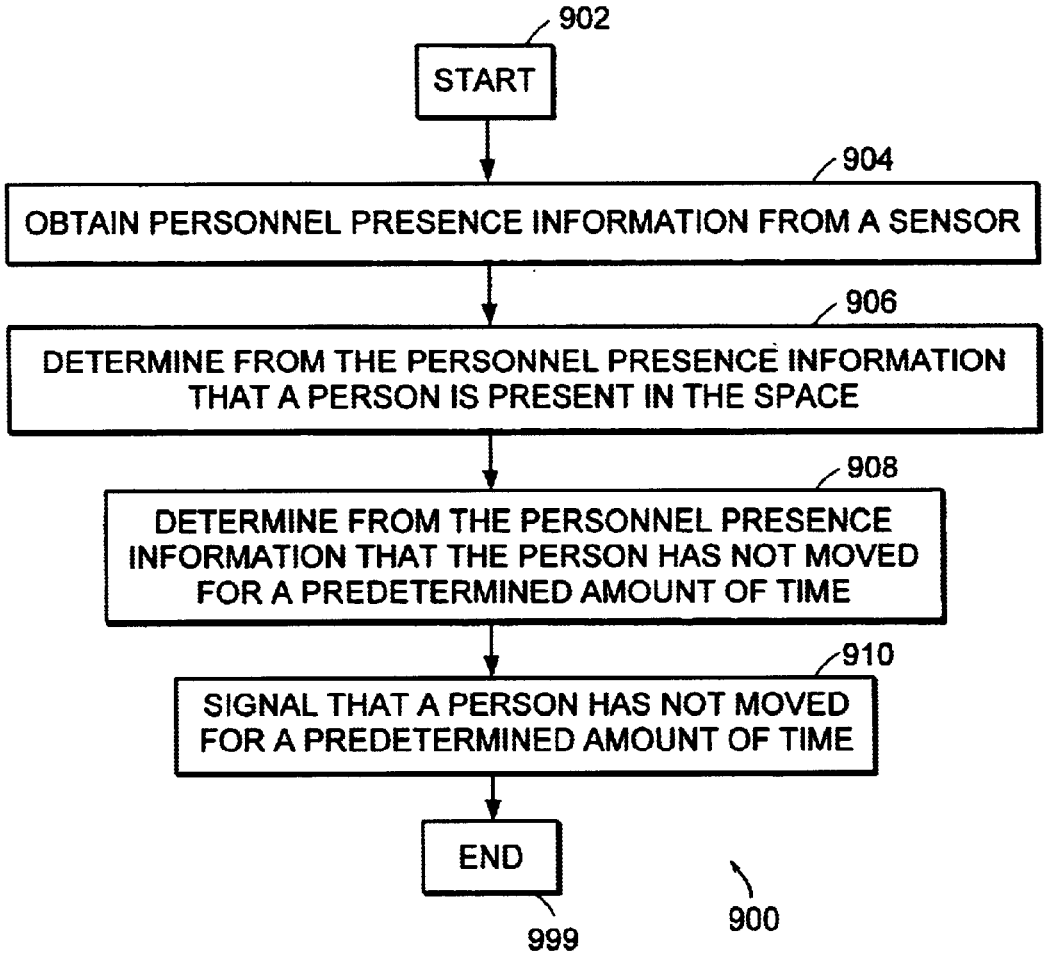
FIG. 9 is a logic flow diagram showing an example of personnel presence monitoring/signaling logic for signaling that a person has not moved for a predetermined amount of time sensor in accordance with an embodiment of the present invention.

FIG. 9 shows an example of personnel presence monitoring/signaling logic 900 for signaling that a person has not moved for a predetermined amount of time. Beginning at block 902, the logic obtains personnel presence information from a sensor, in block 904. The logic determines from the personnel presence information that a person is present in the space, in block 906. The logic determines from the personnel presence information that the person has not moved for a predetermined amount of time, in block 908. The logic signals that a person has not moved for a predetermined amount of time, in block 910. The logic 900 terminates in block 999.

Still another personnel presence condition is that a person has left a space. Such a personnel presence condition may be determined by the personnel presence monitoring/signaling logic 106 upon detecting the absensce of a person from the space where a person had been present in the space.

Figure 10:
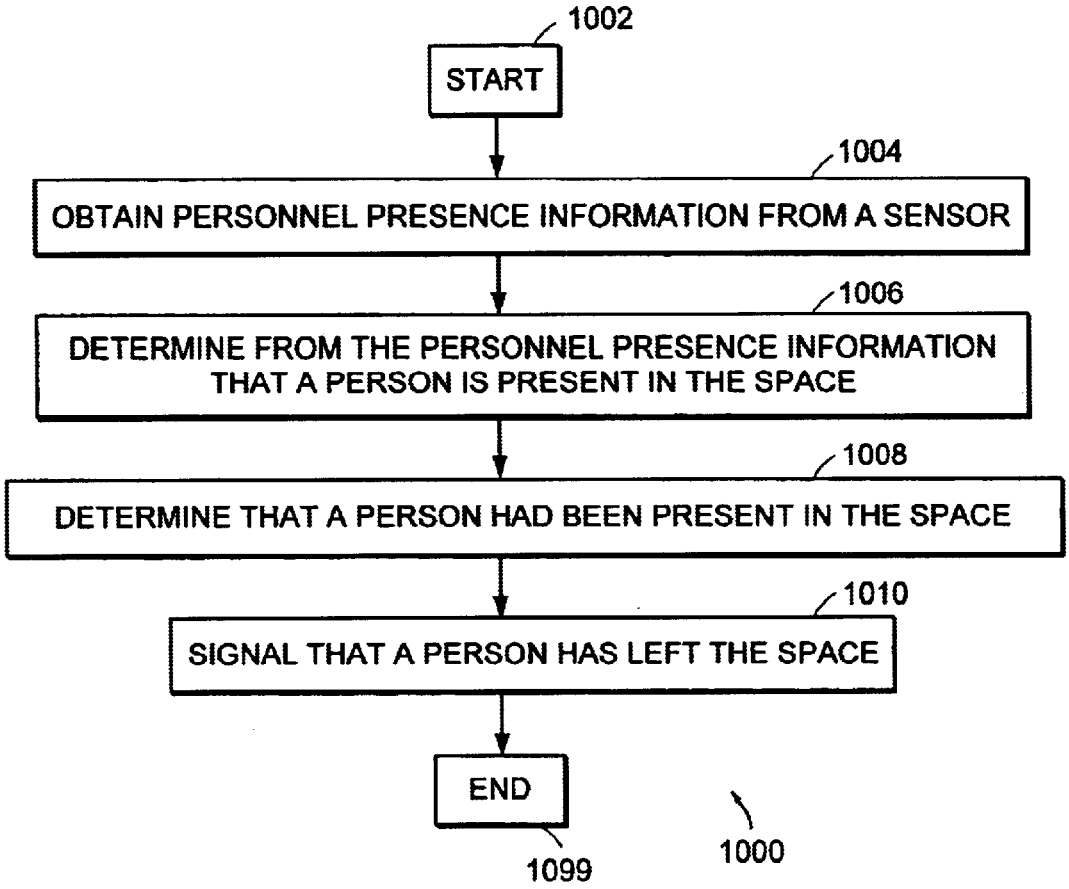
FIG. 10 is a logic flow diagram showing an example of personnel presence monitoring/signaling logic for signaling that a person has left a space sensor in accordance with an embodiment of the present invention.

FIG. 10 shows an example of personnel presence monitoring/signaling logic 1000 for signaling that a person has left a space. Beginning at block 1002, the logic obtains personnel presence information from a sensor, in block 1004. The logic determines from the personnel presence information that a person is not present in the space, in block 1006. The logic determines that a person had been present in the space, in block 1008. The logic signals that a person has left the space, in block 1010. The logic 1000 terminates in block 1099.

Still another personnel presence condition is the position of a person within a space. A single sensor or multiple sensors may be used by the personnel presence monitoring/signaling logic 106 to determine the position of the person within the space. Signaling of such a personnel presence condition may be useful, for example, in locating victims in a fire or locating an intruder within a building.

Figure 11:
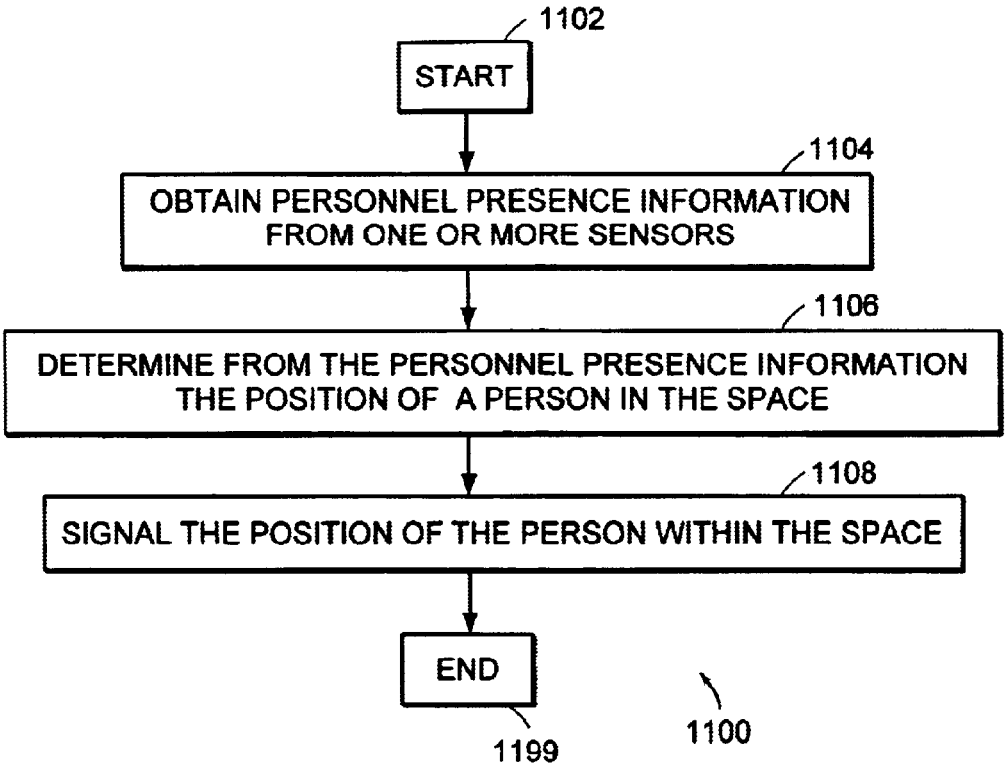

FIG. 11 shows an example of personnel presence monitoring/signaling logic 1100 for signaling the position of a person within a space. Beginning at block 1102, the logic obtains personnel presence information from one or more sensors, in block 1104. The logic determines from the personnel presence information the position of a person in the space, in block 1106. The logic signals the position of the person within the space, in block 1108. The logic 1100 terminates in block 1199.

Still another personnel presence condition is the direction of motion of a person within a space. Because the output signal of the at least one sensor 108 various according to the proximity of the person to the at least one sensor 108, the personnel presence monitoring/signaling logic 106 may determine the direction of motion of the person within the space. Signaling of such a personnel presence condition may be useful, for example, for warning a person of a danger (e.g., watch your step) or opening or closing a door.

Figure 12:
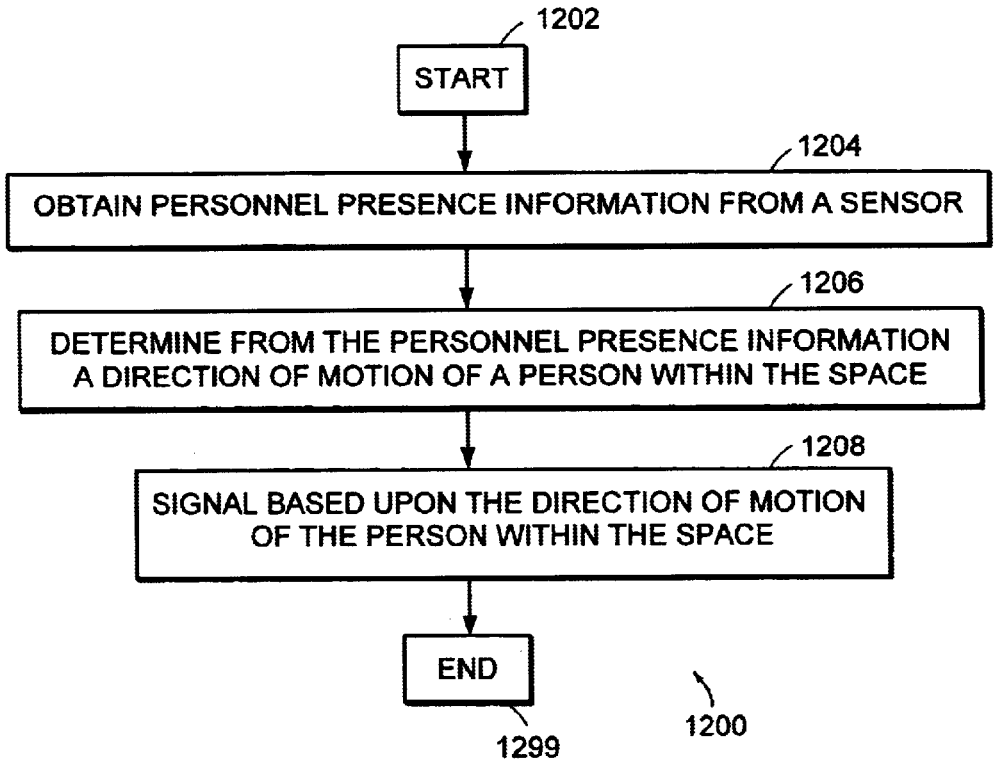
FIG. 12 is a logic flow diagram showing an example of personnel presence monitoring/signaling logic for signaling the direction of motion of a person within a space sensor in accordance with an embodiment of the present invention.

FIG. 12 shows an example of personnel presence monitoring/signaling logic 1200 for signaling the direction of motion of a person within a space. Beginning at block 1202, the logic obtains personnel presence information from a sensor, in block 1204. The logic determines from the personnel presence information a direction of motion of a person within the space, in block 1206. The logic signals based upon the direction of motion of the person within the space, in block 1208. The logic 1200 terminates in block 1299.

Use of the personnel presence monitoring/signaling logic 106 in a networking environment allows for remote personnel presence monitoring and control. Although the possible uses for such remote personnel presence monitoring and control are too numerous to list herein, a number of examples are included below.

One use for remote personnel presence monitoring and control is for detecting burglars and other intruders in a building. For example, in an Internet environment, various sensors in a building can be monitored from a personal computer, for example, using a World Wide Web (WWW) interface, and personnel presence condition signals can be received from the personnel presence monitoring/signaling logic, for example, via email messages. Before entering the building, the building can be checked for intruders, including determining whether there had been an intrusion and, if so, whether the intruder is still present. Such information may be useful in deciding whether or not it is safe to enter the building. Furthermore, if the intruder is still present, the personnel presence monitoring/signaling logic can be queried for the position of the intruder (and possibly others) within the building. Such information may be useful for law enforcement officials to plan an attack against the intruder.

Another use for remote personnel presence monitoring and control is for locating victims in a fire. For example, rather than scouring a building for victims, firemen can query the personnel presence monitoring/signaling logic 106 as to the location of people within the building, and can then go directly to those people without having to search the building.

Yet another use for remote personnel presence monitoring and control is for confirming that a person is present in a building. For example, an employer may remotely monitor the comings and goings of employees, or a parent may remotely monitor the comings and goings of children.

The distributed personnel presence monitoring/signaling system described with reference to FIG. 3 above provides various business opportunities. Although the possible business opportunities are too numerous to list herein, a number of examples are included below.

One example of a business opportunity is an inexpensive, easily expandable security system. A person may purchase a central controller and a number of plug-in sensors. The plug-in sensors are placed throughout the home. Plug-in sensors are expected to be relatively inexpensive, and can be easily added to the system in order to expand the system. A full security system can be built without running-wires, making it particularly useful to install the security system in an existing home.

Another example of a business opportunity is a portable personnel monitoring system. For example, a company can offer for rent or lease a temporary home security service that uses plug-in sensors coupled to a central controller over a wireless communication system. The sensors are merely plugged into outlets around the home. The central controller may also be installed within the house. The system can be monitored remotely by the company and/or the home owner. When the service is no longer needed (for example, when the home owner returns from an extended trip), the sensors may be returned to the company.

It should be noted that the logic flow diagrams are used herein to demonstrate various aspects of the invention, and should not be construed to limit the present invention to any particular logic flow or logic implementation. The described logic may be partitioned into different logic blocks (e.g., programs, modules, functions, or subroutines) without changing the overall results or otherwise departing from the true scope of the invention. Often times, logic elements may be added, modified, omitted, performed in a different order, or implemented using different logic constructs (e.g., logic gates, looping primitives, conditional logic, and other logic constructs) without changing the overall results or otherwise departing from the true scope of the invention.

The personnel presence monitoring/signaling logic 106 may be embodied in many different forms, including, but in no way limited to, computer program logic for use with a processor (e.g., a microprocessor, microcontroller, digital signal processor, or general purpose computer), programmable logic for use with a programmable logic device (e.g., a Field Programmable Gate Array (FPGA) or other PLD), discrete components, integrated circuitry (e.g., an Application Specific Integrated Circuit (ASIC)), or any other means including any combination thereof. In a typical embodiment of the present invention, predominantly all of the personnel presence monitoring/signaling logic 106 is implemented as a set of computer program instructions that is converted into a computer executable form, stored as such in a computer readable medium, and executed by a microprocessor within a personnel presence monitoring/signaling device (200, 300) under the control of an operating system.

Computer program logic implementing all or part of the functionality previously described herein may be embodied in various forms, including, but in no way limited to, a source code form, a computer executable form, and various intermediate forms (e.g., forms generated by an assembler, compiler, linker, or locator). Source code may include a series of computer program instructions implemented in any of various programming languages (e.g., an object code, an assembly language, or a high-level language such as Fortran, C, C++, JAVA, or HTML) for use with various operating systems or operating environments. The source code may define and use various data structures and communication messages. The source code may be in a computer executable form (e.g., via an interpreter), or the source code may be converted (e.g., via a translator, assembler, or compiler) into a computer executable form.

The computer program may be fixed in any form (e.g., source code form, computer executable form, or an intermediate form) either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), or other memory device. The computer program may be fixed in any form in a signal that is transmittable to a computer using any of various communication technologies, including, but in no way limited to, analog technologies, digital technologies, optical technologies, wireless technologies, networking technologies, and internetworking technologies. The computer program may be distributed in any form as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

Hardware logic (including programmable logic for use with a programmable logic device) implementing all or part of the functionality previously described herein may be designed using traditional manual methods, or may be designed, captured, simulated, or documented electronically using various tools, such as Computer Aided Design (CAD), a hardware description language (e.g., VHDL or AHDL), or a PLD programming language (e.g., PALASM, ABEL, or CUPL).

Programmable logic may be fixed either permanently or transitorily in a tangible storage medium, such as a semiconductor memory device (e.g., a RAM, ROM, PROM, EEPROM, or Flash-Programmable RAM), a magnetic memory device (e.g., a diskette or fixed disk), an optical memory device (e.g., a CD-ROM), or other memory device. The programmable logic may be fixed in a signal that is transmittable to a computer using any of various communication technologies, including, but in no way limited to, analog technologies, digital technologies, optical technologies, wireless technologies, networking technologies, and internetworking technologies. The programmable logic may be distributed as a removable storage medium with accompanying printed or electronic documentation (e.g., shrink wrapped software), preloaded with a computer system (e.g., on system ROM or fixed disk), or distributed from a server or electronic bulletin board over the communication system (e.g., the Internet or World Wide Web).

The present invention may be embodied in other specific forms without departing from the true scope of the invention. The described embodiments are to be considered in all respects only as illustrative and not restrictive.

We claim:

1. A system comprising:

at least one personnel presence sensor, said personnel presence sensor capable of detecting the distance between a person and the personnel presence sensor; and personnel presence monitoring/signaling logic operably coupled to receive personnel presence information from the at least one personnel presence sensor for monitoring and signaling personnel presence by indicating the distance between person and the personnel presence sensor by providing an output varying among a range of at least three values according to the detected distance.

2. The system of claim 1, wherein the at least one personnel presence sensor and the personnel presence monitoring/signaling logic are integrated within a device.

3. The system of claim 1, wherein the at least one personnel presence sensor and the personnel presence monitoring/signaling logic are distributed.

4. The system of claim 3, wherein the at least one personnel presence sensor and the personnel presence monitoring/signaling logic communicate over a communication medium.

5. The system of claim 4, wherein the communication medium comprises a wireless communication network.

6. The system of claim 5, wherein the wireless communication network comprises a Bluetooth wireless communication network.

7. The system of claim 4, wherein the communication medium comprises a wire-line communication network.

8. The system of claim 7, wherein the wire-line communication network comprises a power line communication network.

9. The system of claim 1, further comprising a local signal coupled to the personnel presence monitoring/signaling logic.

10. The system of claim 1, further comprising a remote signal coupled to the personnel presence monitoring/signaling logic.

11. The system of claim 1, wherein the personnel presence monitoring/signaling logic is operably coupled to a communication network for remote monitoring and control by a remote terminal.

12. A device comprising:

at least one personnel presence sensor, said personnel presence sensor capable of detecting the distance between a person and the personnel presence sensor, said at least one personnel presence sensor capable of indicating said distance by providing an output that varies according to the detected distance, the output varying in a range of at least three values; and personnel presence monitoring/signaling logic operably coupled to receive personnel presence information from the at least one personnel presence sensor for monitoring and signaling personnel presence.

13. The device of claim 12, further comprising a local signal coupled to the personnel presence monitoring/signaling logic.

14. The device of claim 12, further comprising a remote signal interface coupled to the personnel presence monitoring/signaling logic.

15. The device of claim 12, further comprising a network interface coupled to the personnel presence monitoring/signaling logic for remote monitoring and control by a remote terminal.

16. The device of claim 15, wherein the network interface comprises an Internet network interface.

17. A device comprising:

a personnel presence sensor for generating personnel presence information, said personnel presence sensor capable of detecting the distance between a person and the personnel presence sensor, said personnel presence sensor capable of indicating said distance by providing an output that varies among a range of at least three values according to the detected distance; and a communication interface for sending the personnel presence information over a communication medium.

18. The device of claim 17, further comprising a power connector for coupling to an electrical power system.

19. The device of claim 17, wherein the communication medium comprises a wireless communication network.

20. The device of claim 19, wherein the wireless communication network comprises a Bluetooth wireless communication network.

21. The device of clam 17, wherein the communication medium comprises a wire-line communication network.

22. The device of claim 21, wherein the wire-line communication network comprises a power line communication network.

23. The device of claim 17, further comprising control logic interposed between the communication interface and the personnel presence sensor for interfacing the communication interface and the personnel presence sensor.

24. A method for monitoring and signaling personnel presence, the method comprising:

installing a number of personnel presence sensors in a space, at least one personnel presence sensor capable of detecting the distance between a person and the personnel presence sensor and of indicating said distance by providing an output that varies among a range of at least three values according to the detected distance; and obtaining personnel presence information about a person from the number of personnel presence sensors; and determining from the personnel presence information any of a number of predetermined personnel presence conditions.

25. The method of claim 24, wherein the personnel presence sensors are plug-in sensors, and wherein installing a number of personnel presence sensors in a space comprises plugging the plug-in sensors in an electrical power source.

26. The method of claim 24, wherein obtaining personnel presence information from the number of personnel presence sensors comprises:

sending the personnel presence information by the personnel presence sensors to personnel presence monitoring/signaling logic.

27. The method of claim 24, wherein obtaining personnel presence information from the number of personnel presence sensors comprises:

retrieving the personnel presence information from the personnel presence sensors by personnel presence monitoring/signaling logic.

28. The method of claim 24, wherein determining from the personnel presence information any of a number of predetermined personnel presence conditions comprises:

indicating that a person is present in the space.

29. The method of claim 24, wherein determining from the personnel presence information any of a number of predetermined personnel presence conditions comprises:

indicating that a person is not present in the space.

30. The method of claim 24, wherein determining from the personnel presence information any of a number of predetermined personnel presence conditions comprises:

indicating that a person has entered the space.

31. The method of claim 24, wherein determining from the personnel presence information any of a number of predetermined personnel presence conditions comprises:

indicating that a person has moved within the space.

32. The method of claim 24, wherein determining from the personnel presence information any of a number of predetermined personnel presence conditions comprises:

indicating that a person has remained in the space.

33. The method of claim 24, wherein determining from the personnel presence information any of a number of predetermined personnel presence conditions comprises:

indicating that a person has not moved for a predetermined amount of time.

34. The method of claim 24, wherein determining from the personnel presence information any of a number of predetermined personnel presence conditions comprises:

indicating that a person has left the space.

35. The method of claim 24, wherein determining from the personnel presence information any of a number of predetermined personnel presence conditions comprises:

indicating a position of a person within the space.

36. The method of claim 24, wherein determining from the personnel presence information any of a number of predetermined personnel presence conditions comprises:

indicating a direction of motion of a person within the space.

37. The method of claim 24, further comprising:

signaling a personnel presence condition.

* * * * *